US009765952B2

(12) United States Patent
Zanotto et al.

(10) Patent No.: US 9,765,952 B2
(45) **Date of Patent: *Sep. 19, 2017**

(54) MOUNTING DEVICE FOR LIGHTING SOURCES

(71) Applicant: OSRAM GmbH, Munich (DE)

(72) Inventors: Alberto Zanotto, Padua (IT); Simon Bobbo, Chirignago (IT); Alberto Alfier, Vedelago (IT); Franco Zanon, Cassola (IT); Matteo Toscan, Rosenheim (DE); Lorenzo Roberto Trevisanello, Abana Terme (IT)

(73) Assignee: Osram GmbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/350,565

(22) PCT Filed: Oct. 2, 2012

(86) PCT No.: PCT/EP2012/069479

§ 371 (c)(1),
(2) Date: Apr. 9, 2014

(87) PCT Pub. No.: WO2013/053625

PCT Pub. Date: Apr. 18, 2013

(65) Prior Publication Data

US 2014/0268834 A1 Sep. 18, 2014

(30) Foreign Application Priority Data

Oct. 13, 2011 (IT) ..... TO2011A0910

(51) Int. Cl.
*F21V 19/00* (2006.01)
*F21V 29/70* (2015.01)
(Continued)

(52) U.S. Cl.
CPC ..... *F21V 19/00* (2013.01); *F21V 19/0035* (2013.01); *F21V 19/0045* (2013.01);
(Continued)

(58) Field of Classification Search
CPC ..... F21V 19/00; F21V 19/001; F21V 19/015; F21V 19/003; F21V 19/0035;
(Continued)

(56) References Cited

U.S. PATENT DOCUMENTS 1,589,142 A * 6/1926 Godley ..... 362/374
1,589,144 A * 6/1926 Godley ..... 362/374
(Continued)

FOREIGN PATENT DOCUMENTS

CN 101737684 A1 6/2010
EP 1936263 A1 6/2008
(Continued)

OTHER PUBLICATIONS

International Search Report issued in PCT/EP2012/069479 dated May 6, 2013.
(Continued)

*Primary Examiner* — Andrew Coughlin
*Assistant Examiner* — Colin Cattanach
(74) *Attorney, Agent, or Firm* — Viering, Jentschura & Partner mbB

(57) ABSTRACT

A device for mounting lighting sources on a substrate includes a channel-like mounting frame provided with fixing formations for fixing on said substrate, said mounting frame defining a cavity for receiving said lighting source with said lighting source resting on said substrate, a slider member which can be positioned in said cavity of said mounting frame to urge said lighting source toward said substrate; said slider member being slidable with respect to said mounting frame between an insertion position and a locking position,
(Continued)

wherein said mounting frame and said slider member bear complementary engagement formations cooperating in a ramp-like manner to force said slider member and the lighting source urged thereby toward said substrate when said slider member is advanced from said insertion position toward said locking position.

9 Claims, 4 Drawing Sheets

(51) Int. Cl.
*F21V 17/12* (2006.01)
*F21V 29/76* (2015.01)
*F21Y 115/10* (2016.01)

(52) U.S. Cl.
CPC ..... *F21V 29/70* (2015.01); *F21V 17/12* (2013.01); *F21V 29/76* (2015.01); *F21Y 2115/10* (2016.08)

(58) Field of Classification Search
CPC ..... F21V 19/0045; F21V 29/70; F21V 29/76; F21V 17/12; F21V 17/14; F21V 17/104; F21Y 2101/02
USPC ..... 362/249.1
See application file for complete search history.

(56) References Cited

U.S. PATENT DOCUMENTS 6,998,650 B1 * 2/2006 Wu ..... F21K 9/00 257/100
7,405,944 B2 * 7/2008 Mayer ..... F21V 19/0045 29/758
7,661,854 B1 * 2/2010 Yang et al. ..... 362/373
7,988,336 B1 * 8/2011 Harbers et al. ..... 362/294
8,410,672 B2 * 4/2013 Rebergen ..... F21K 9/00 313/113
8,926,146 B2 * 1/2015 Alfier ..... F21V 19/0035 362/382
2003/0189829 A1 * 10/2003 Shimizu et al. ..... 362/240
2005/0180157 A1 * 8/2005 Watanabe et al. ..... 362/543
2006/0061997 A1 * 3/2006 Lin ..... 362/294
2006/0141851 A1 * 6/2006 Matsui et al. ..... 439/490
2006/0169991 A1 * 8/2006 Kikuchi ..... H01L 33/62 257/81
2006/0187660 A1 * 8/2006 Liu ..... F21V 29/004 362/294
2007/0109806 A1 5/2007 Tsukamoto et al.
2009/0080198 A1 * 3/2009 Thornton ..... 362/297
2009/0097249 A1 * 4/2009 Lee et al. ..... 362/249.02
2009/0207617 A1 * 8/2009 Merchant et al. ..... 362/294
2010/0072505 A1 * 3/2010 Gingrich, III ..... 257/99
2010/0315815 A1 * 12/2010 Lin et al. ..... 362/249.01
2010/0315823 A1 * 12/2010 Lin et al. ..... 362/368
2010/0328961 A1 * 12/2010 Kwon et al. ..... 362/375
2011/0031864 A1 * 2/2011 Rebergen ..... 313/11
2011/0063849 A1 * 3/2011 Alexander et al. ..... 362/294
2011/0069502 A1 * 3/2011 Hum ..... 362/373
2013/0034989 A1 * 2/2013 Vogt et al. ..... 439/485
2013/0077324 A1 * 3/2013 Schroll ..... F21V 19/002 362/382
2013/0088876 A1 * 4/2013 Harbers ..... F21V 29/00 362/294

FOREIGN PATENT DOCUMENTS

NL WO2010146509 A1 * 12/2010 ..... F21V 17/14
WO 2009128005 A1 10/2009

OTHER PUBLICATIONS

Chinese Office Action based on application No. 201280050487.3 (10 pages) dated Mar. 25, 2016 (for reference purpose only).

* cited by examiner

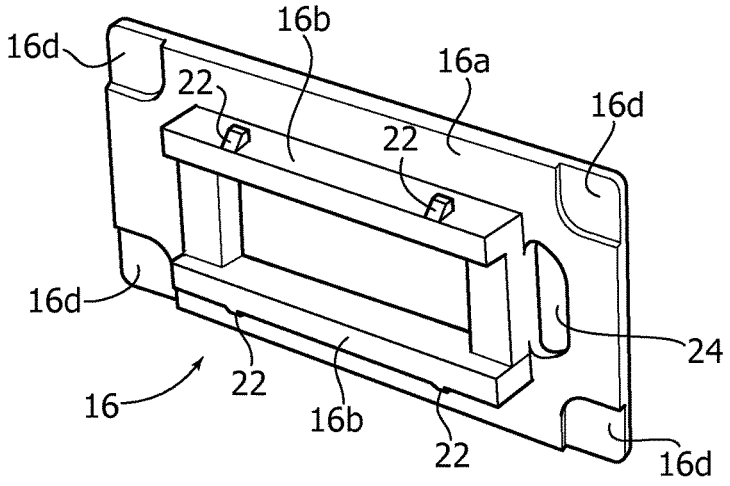
FIG. 6
FIG. 7
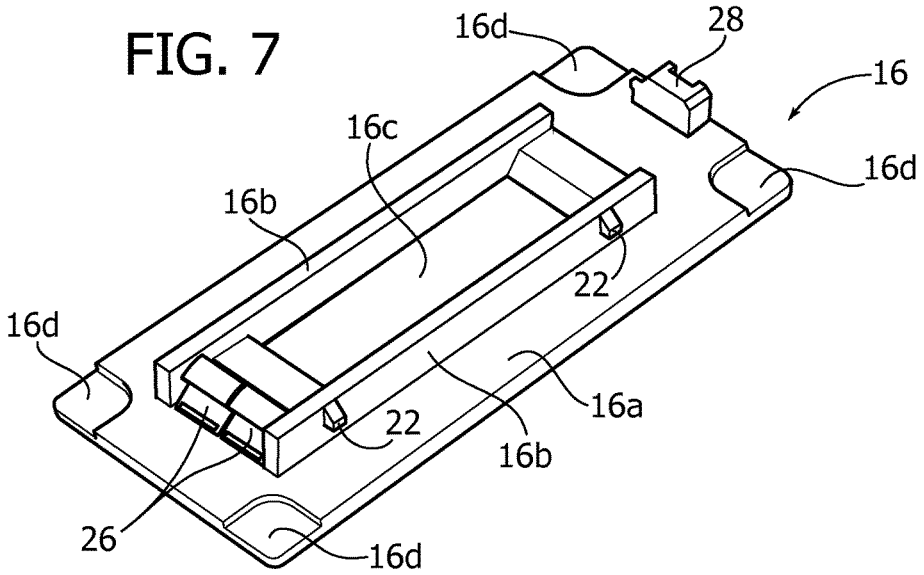
FIG. 8
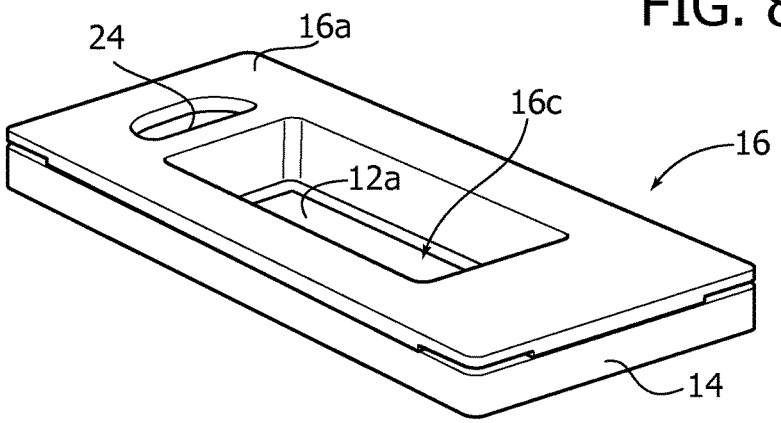

MOUNTING DEVICE FOR LIGHTING SOURCES

RELATED APPLICATIONS

The present application is a national stage entry according to 35 U.S.C. §371 of PCT application No.: PCT/EP2012/069479 filed on Oct. 2, 2012, which claims priority from Italian application No.: TO2011A000910 filed on Oct. 13, 2011, and is incorporated herein by reference in its entirety.

TECHNICAL FIELD

Various embodiments relate to devices for mounting lighting sources.

Various embodiments may relate to devices for mounting LED lighting sources, for example of the type referred to as Chip-on-Board (CoB).

BACKGROUND

In various solutions, a CoB device can be mounted on a printed circuit board (PCB) using adhesives, ensuring an electrical connection using the technique referred to as wire bonding, for example.

This solution has a number of disadvantages.

Firstly, the mechanical contact does not allow uniform distribution of the pressure, and therefore the thermal interface properties and the transfer of the heat generated during operation of the lighting source are not uniform over the entire contact surface.

The operation of directly soldering the connection wires to the PCB card of the CoB component may then result in damage to the optical part (lens) of the LED module, causing the optical properties to worsen.

In any event, the production process is adversely affected, and this may require a manual soldering operation and in various solutions it is necessary to protect the contacts using a shell.

SUMMARY

Various embodiments provide a simple solution so as to make it possible to mount a lighting source, for example arranged on a dedicated PCB card (for example CoB), on a substrate such as, for example, a heat sink capable of constituting an integral part of the lighting system ("luminaire").

In various embodiments, the presence of resilient mounting formations, for example elastic mounting formations such as special bushings, guarantees optimum mechanical contact.

In various embodiments, a system with pins, for example extruded pins, cooperating with ramp-like guides makes it possible to achieve a uniform pressure and optimum thermal coupling.

In various embodiments, scraping contacts may be present in order to realize the electrical connection.

Various embodiments make it possible to achieve one or more of the following advantages:

- optimum mechanical contact between the lighting source (for example CoB) and the surface of a substrate, for example a heat sink;
- reliable and efficient electrical contact;
- easy and quick mounting process owing to the presence of a sliding member; the operation of possibly replacing the lighting sources (for example CoB) is simplified in that it is not necessary to loosen screws for electrically and mechanically disconnecting the lighting source;
- it is possible to mount a reflector;
- stable and reliable standard mounting structure (also thermally);
- it is possible to achieve a uniform contact pressure between the lighting source (for example CoB) and the substrate, for example a heat sink, so as to make it possible to effect an optimum thermal connection;
- it is possible to easily implement arrays of lighting sources;
- efficient absorption of the tolerances of the parts which are assembled; and
- it is possible to use different connectors for implementing the electrical contact.

Various embodiments may be used in different applications, preferably—but not necessarily—together with a CoB module.

Various embodiments enable use in a street lighting device, with simplified mounting and maintenance operations.

BRIEF DESCRIPTION OF THE FIGURES

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which:

FIGS. 6 to 8 show a member of embodiments in various perspective views.

DETAILED DESCRIPTION

The following detailed description refers to the accompanying drawing that show, by way of illustration, specific details and embodiments in which the disclosure may be practiced.

In the following description, various specific details aimed at providing a fuller understanding of the embodiments are explained. The embodiments may be implemented without one or more of the specific details or using other methods, components, materials, etc. In other cases, known structures, materials or operations are not shown or described in detail so that the various aspects of the embodiments may be understood more clearly.

The reference to "an embodiment" in the context of this description indicates that a particular configuration, structure or feature described in relation to the embodiment is included in at least one embodiment. Therefore, phrases such as "in one embodiment", which may occur at various points in this description, do not necessarily refer to the same embodiment. Moreover, particular forms, structures or features may be combined in any suitable manner in one or more embodiments.

The reference signs used here are provided solely for the sake of convenience and therefore do not define the scope of protection or ambit of the embodiments.

Figure 1:
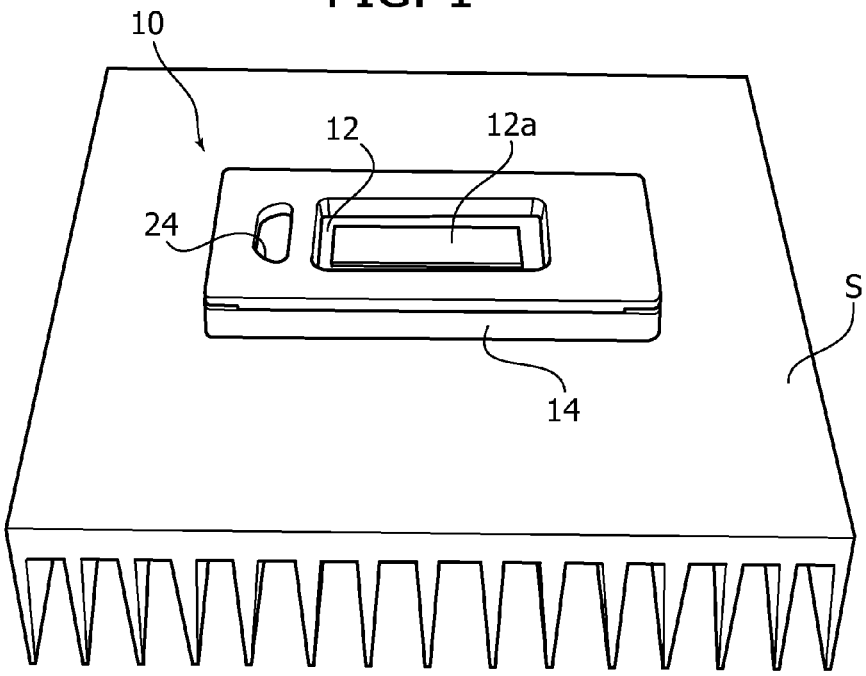
FIG. 1 is a general perspective view of a device according to one embodiment.
Figure 2:
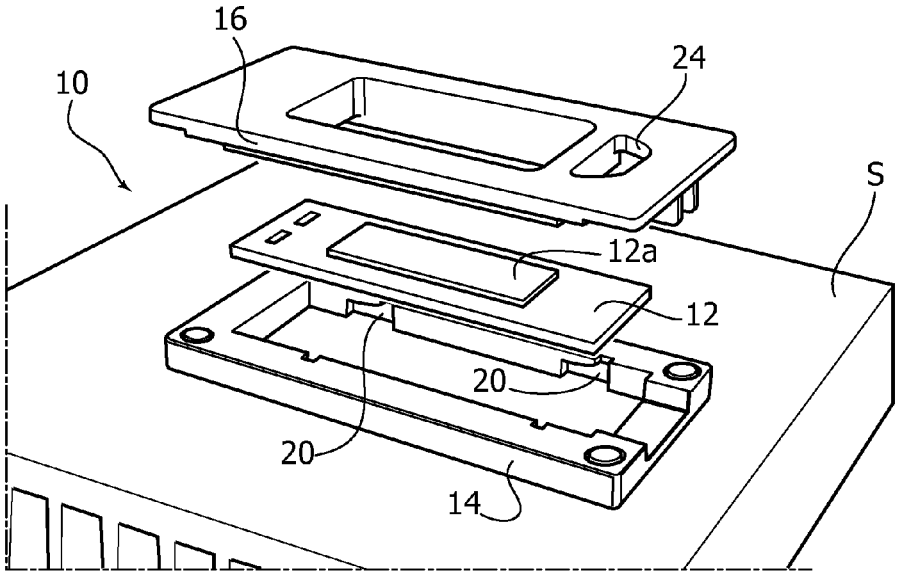
FIG. 2 shows the device shown in FIG. 1 in an exploded view.

FIGS. 1 and 2 show the combined features of various embodiments of a device, denoted as a whole by 10, which makes it possible for a lighting source 12 to be mounted on a substrate S.

In various embodiments, the substrate S may be constituted by a heat sink or by the body of a lighting device ("luminaire") of any known type, not expressly visible in the figures.

In various embodiments, the lighting source 12 may be constituted by an LED light radiation source. In various embodiments, it may be an LED lighting source implemented according to the solution known as Chip-on-Board or CoB.

In various embodiments, the lighting source 12 may be a planar lighting source, for example in the form of a board in which there is an active portion 12*a* (for example LED) constituting the actual lighting source.

As can be seen more clearly in the exploded perspective view in FIG. 2, in various embodiments the lighting source 12 may be mounted on the substrate S with a device including a mounting frame 14 and a sliding member or slider 16.

Figure 3:
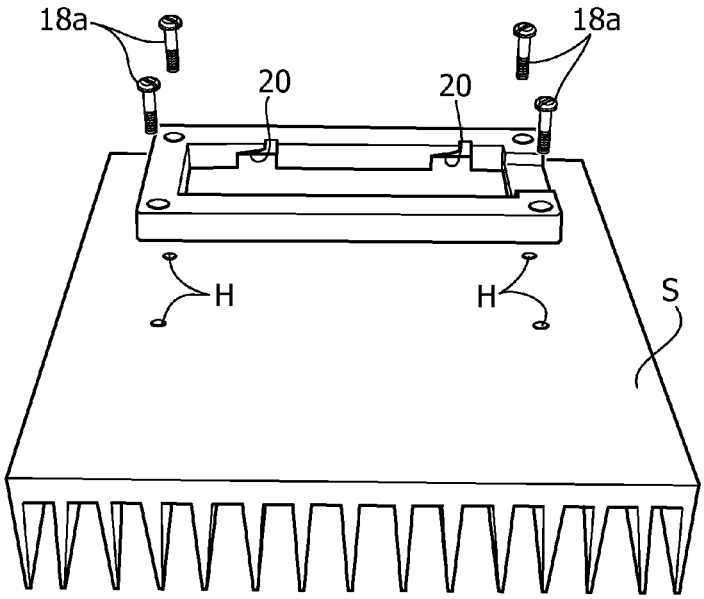
FIGS. 3 to 5 show various views of one of the members of one embodiment.
Figure 4:
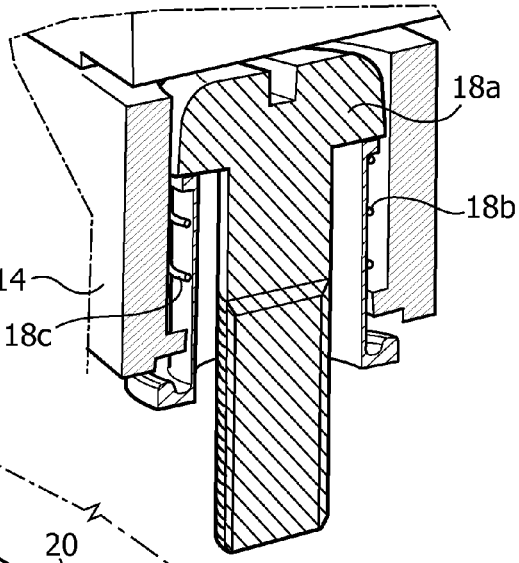
Figure 5:
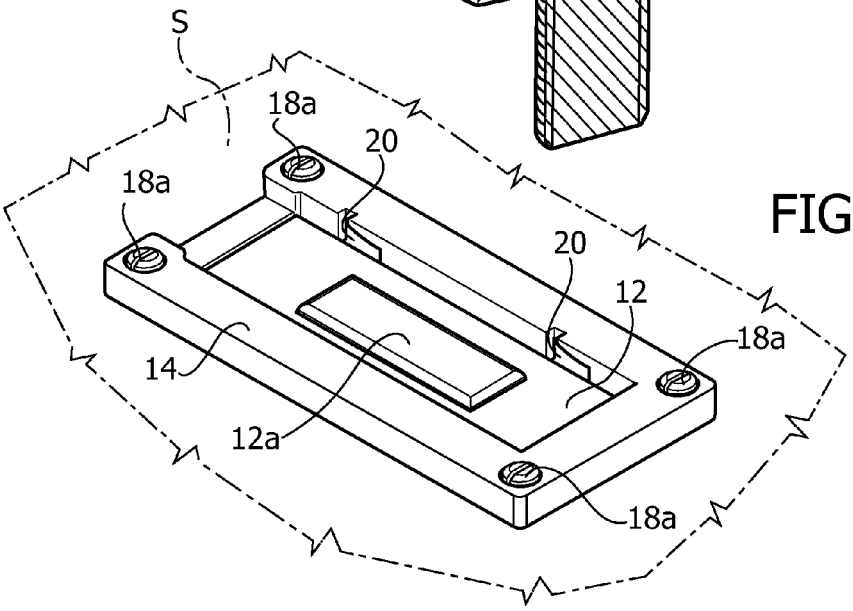

As can be seen more clearly by observing FIGS. 3 to 5, in various embodiments the frame 14 may have a general channel-like shape and define, internally, a cavity in which the lighting source 12 may be mounted resting on the surface S, as can be seen more clearly by observing FIG. 5.

In various embodiments, the frame 14 may be fixed on the substrate S by means of fixing formations which, in various embodiments, may include (see in particular FIGS. 3 and 4):

- a screw or rivet 18*a* capable of extending from the frame to engage a corresponding opening H (for example a threaded hole) provided on the surface of the substrate S, and
- a bushing 18*b* fitted on the screw or rivet 18*a* and acting as a guide member for a resilient member 18*c*, which can be constituted, in various embodiments, by a helical spring fitted around the bushing 18*b*.

Whichever the specific embodiment adopted (for example, the spring 18*c* could be fitted directly on the screw or rivet 18*a*, or could be substituted by an equivalent resilient member, such as an elastic sleeve), the fixing formations described make it possible for the frame 14 to be mounted on the substrate S with the possibility to regulate the force with which the frame 14 is urged against said substrate S.

This result can be obtained by regulating and/or appropriately selecting the features of resilience of the resilient member, such as the spring 18*c*.

In various embodiments, it is moreover possible to select the thickness or height of the frame 14 such that, when it is fixed on the substrate S, the frame 14 remains at a distance from the surface of the substrate S (see for example the distance d shown in FIG. 11), so that it does not make contact with the surface of the substrate S.

This solution is advantageous for achieving uniform distribution of the force exerted (according to the methods described in more detail hereinbelow) on the lighting source 12 to make it rest on the substrate S.

As can be seen more clearly in the views in FIGS. 6 and 7, the general channel-like shape of the frame 14 may be comparable with a corresponding, at least partial channel-like shape of the slider 16.

In various embodiments, the slider 16 may include a web portion 16*a*, with an extent at least approximately complementary to the course of the frame 14 (for example rectangular, in the embodiments under consideration here), and two lateral branches 16*b* which are capable of giving the slider 16 a channel-like shape overall which is complementary to that of the frame 14, with the side walls 16*b* of the slider 16 positioned so as to extend within the frame 14.

The side walls 16*b* can thus press on the lighting source 12 (for example on the sides of the board which bears the active member 12*a*) so as to urge the lighting source 12 toward the position in which it rests on the substrate S.

In various embodiments, the frame 14 and the slider 16 bear complementary engagement formations intended to cooperate with one another in a ramp-like manner.

In various embodiments, the aforementioned complementary structures may include:

- one or more ramp-like cavities 20, arranged for example on the frame 14, and
- one or more pins 22 protruding from the sides of the slider 16.

The accompanying drawings refer to exemplary embodiments which have:

- four ramp-like cavities 20 arranged in two mutually facing pairs of cavities on the sides of the frame 14, and
- four pins 22 arranged in two pairs of facing pins on the sides 16*b* of the slider 16.

The number of complementary formations can of course differ from that under consideration here. In addition, the relative arrangement could be reversed (at least in part), with one or more cavities arranged on the slider 16 and one or more pins arranged on the frame 14.

In addition, the complementary ramp-like formations (or cam-like formations, as they may also be called) could have a different shape, it being understood that, in various embodiments, these complementary engagement formations 20, 22 can ensure that the longitudinal advancing movement of the slider 16 within the frame 14 causes the slider 16 to be forced or urged toward the surface of the substrate S.

Figure 9:
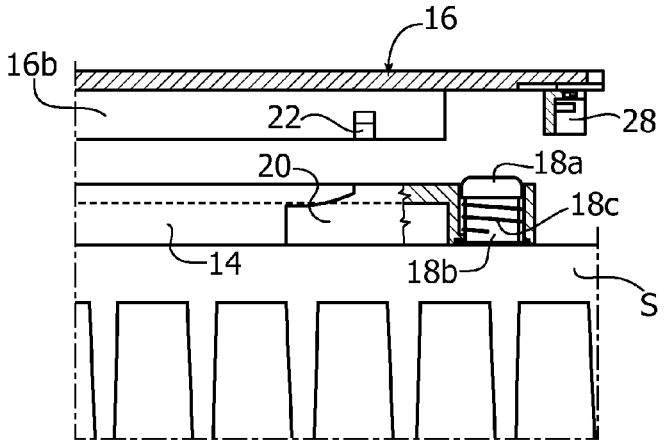
FIGS. 9 to 11 show a mounting sequence for embodiments.
Figure 10:
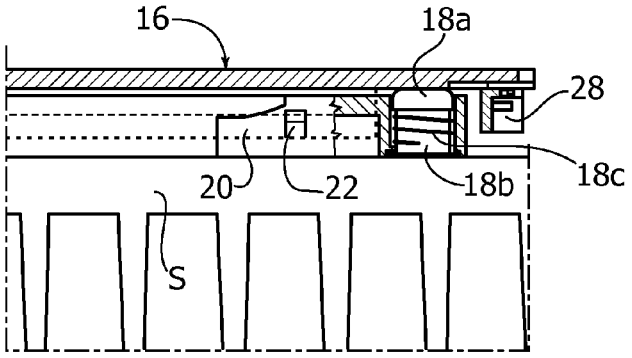
Figure 11:
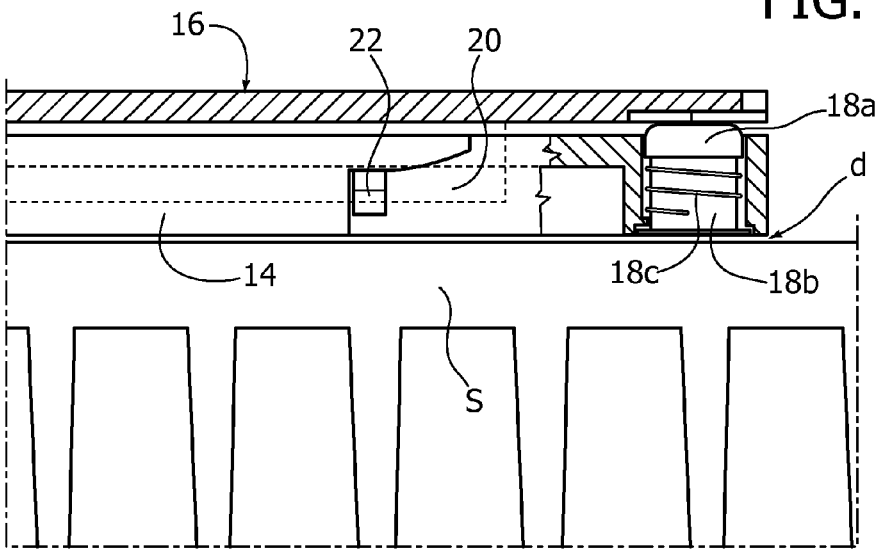

In various embodiments, the sliding movement of the slider 16 with respect to the frame 14 is carried out between:

- a withdrawn insertion position (shown in FIG. 9), in which the slider 16 can be inserted in the frame 14, with the walls or lateral branches 16*b* being made to penetrate into the frame 14, and
- an advanced locking position (see the sequence in FIGS. 10 and 11) reached by the slider 16 which, positioned in the frame 14, is made to advance within the frame 14 (with a movement from right to left, with reference to the point of observation of FIGS. 9 to 11).

Due to this longitudinal sliding movement, owing to the cooperation between the cavities 20 and the pins 22 (or of corresponding ramp-like complementary members), the slider 16 acts—in particular with the branches 16*a*, in the example under consideration here—on the lighting source 12 in the sense that it urges it toward the surface of the substrate S, into the position in which it rests on the substrate S.

In various embodiments, the slider 16 is provided with a window formation 16*c* (constituted by an opening or by a transparent portion) so as to permit propagation of the light radiation produced by the active part 12*a* and the lighting source 12 toward the outside of the device 10.

In various embodiments, the web part 16*a* of the slider 16 can have imprints 16*d* located in a position complementary to the positions occupied by the fixing formations of the frame 14 on the substrate S (for example imprints 16*d* intended to be turned toward the heads of the screws or rivets 18*a*) so as to realize coupling intended to prevent the slider 16 from accidentally sliding backward from the locking position (FIG. 11) toward the insertion position (FIG. 9).

In addition, in various embodiments the slider 16 can have an engagement formation, such as an eyelet or dimple 24, intended to make it easier to control the sliding movement and/or scraping-type electrical contacts 26 intended to reliably establish electrical contact with the lighting source 12, in particular with tracks or lines for electrical contact which are present on said lighting source (not explicitly visible in the drawings).

In various embodiments, a connector 28 mounted on the slider 16 makes it possible for the lighting source 12 to be electrically connected to a power/drive source (not explicitly shown in the drawings).

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A device for mounting lighting sources on a planar substrate, comprising:

a channel-shaped mounting frame provided with fixing members for fixing on said substrate, said mounting frame defining a cavity for receiving said lighting source with said lighting source resting on said substrate, a slider member configured to position in said cavity of said mounting frame to urge said lighting source toward said substrate; said slider member configured to laterally slide in a plane parallel with said planar substrate between an insertion position and a locking position, wherein said mounting frame and said slider member bear complementary engagement members cooperating in a ramp-shaped manner where the complementary engagement members comprise at least one ramp-shaped cavity and at least one pin engaging the at least one ramp-shaped cavity, said ramp-shaped cavity and said pin being carried by said mounting frame and by said slider member, respectively, and wherein the mounting frame is configured to force said slider member and the lighting source urged thereby toward said substrate into the locking position.

2. The device as claimed in claim 1, wherein said substrate is a heat sink.

3. The device as claimed in claim 1, wherein said fixing members comprise at least one resilient member which resiliently forces said mounting frame toward said substrate.

4. The device as claimed in claim 3, wherein said resilient member includes an elastic member.

5. The device as claimed in claim 1, wherein said fixing members include screws or rivets extending between said mounting frame and said substrate.

6. The device as claimed in claim 1, wherein said slider member has lateral branches extending into the cavity of said mounting frame to urge said lighting source toward said substrate.

7. The device as claimed in claim 1, wherein said slider member includes a window portion permitting propagation of the light radiation produced by said lighting source.

8. The device as claimed in claim 1, wherein the mounting frame is fixed on the substrate, and wherein said mounting frame is exempt from contact with said substrate.

9. The device as claimed in claim 1, wherein said slider member bears scraping contacts for electrical contact with said lighting source.

* * * * *